US006000181A

United States Patent [19]

Wheeler

[11] Patent Number: 6,000,181

[45] **Date of Patent: *Dec. 14, 1999**

[54] APPARATUS AND METHODS OF FORMING A CURVED STRUCTURE

[75] Inventor: Frank Wheeler, Nicoma Park, Okla.

[73] Assignee: Flex-Ability Concepts, L.L.C., Oklahoma City, Okla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/592,200

[22] Filed: Jan. 26, 1996

[51] Int. Cl.[6] ..... E04B 2/82; E04G 21/14

[52] U.S. Cl. ..... 52/241; 52/745.09

[58] Field of Search ..... 52/241, 274, 247, 52/108, 293.3, 745.05, 745.09, 745.1, 745.11, 745.12, 745.13, 745.14

[56] References Cited

U.S. PATENT DOCUMENTS

| | | | |
|---|---|---|---|
| 1,714,174 | 5/1929 | Lichtenberg et al. | 52/105 |
| 2,269,384 | 1/1942 | Spinosa . | |
| 4,805,364 | 2/1989 | Smolik . | |
| 4,894,962 | 1/1990 | Conn | 52/108 |
| 5,090,170 | 2/1992 | Propst | 52/241 |
| 5,291,714 | 3/1994 | Turner | 52/745.07 |
| 5,291,717 | 3/1994 | Turner . | |
| 5,394,665 | 3/1995 | Johnson . | |

OTHER PUBLICATIONS

Brochure of The Flex Trim, Group of Buxton Creek Industries, Bedford, Texas, entitled "The Flex Track ™ System" (undated but admitted to be prior art).

Brochure of United States Gypsum Company entitled "Interior Remodeling Systems" (1987).

*Primary Examiner*—Michael Safavi
*Attorney, Agent, or Firm*—McAfee & Taft

[57] ABSTRACT

An apparatus for forming curved structures comprises a plurality of pivotally connected sections, each section having a track portion, and a strap member adapted for slidably engaging the track portion of the sections such that the sections are movable to form a radius of curvature. A method of forming a curved structure comprises providing runners having a plurality of pivotally connected sections, each section having track portions, and each runner further having two strap members slidably engaging each of the track portions. The method also includes oppositely placing the runners in a curved position such that the runners are substantially aligned and attaching studs between the runners.

21 Claims, 4 Drawing Sheets

APPARATUS AND METHODS OF FORMING A CURVED STRUCTURE

BACKGROUND OF THE INVENTION

This invention relates generally to the field of construction and more particularly, but not by way of limitation, to apparatus and method of forming a curved structure, such as curved walls or archways, barrel ceilings and round columns.

Straight walls are typically constructed using a runner attached to the floor structure, a runner attached to the ceiling structure (or free floating) and studs positioned between and attached to the runners. The runners and studs form a structural frame to which gypsum board, such as SHEETROCK, or other wall covering can be attached. The same principles generally apply to construction of other straight structures. The runners and studs are often formed of wood, such as 2×4's and 2×6's (approximate dimensions of boards in inches). Steel runners and studs are also used, especially in commercial construction as well as in some residential construction.

It is often desirable to construct curved structures, such as curved walls or archways, barrel ceilings and round columns. The principles for constructing curved structures are much the same as those for constructing straight structures except that the runners must form a curved shape.

Various products and methods have been used to form curved structures. One such product is demonstrated in a brochure entitled "The Flex Track™ System," sold through Flex Trim Group, a subsidiary of Burton Creek Industries, located in Bedford, Texas. This product consists of two flexible L-shaped brackets which together comprise a flexible runner to which studs can be attached. However, due perhaps to the product's design and/or flexibility, the strength of a curved structure formed using the Flex Track™ is inadequate.

A method of forming a curved wall is also illustrated in U.S. Pat. No. 5,291,717 to Turner, which is incorporated herein by reference. Turner teaches the use of a tabbed support bracket as a runner. This produces a flimsy curved structure and provides no method to lock or fix the radius of curvature.

Another method of constructing a curved wall is shown in a U.S. Gypsum Company brochure entitled "Interior Remodeling Systems," incorporated by reference herein. This method involves cutting the leg and web sections of a standard steel runner at intervals for the length of the arc. Next, a steel strip is placed inside both runners and attached with fasteners. The runners are then secured to the floor and ceiling structure and studs are fastened to the runners. This method provides adequate strength but is labor-intensive and costly, especially in a commercial setting since many cement-piercing nails must be used to secure the runner to a concrete foundation.

Thus, there is a need for improved apparatus and methods of forming a curved structure which provide adequate strength, minimal labor requirements, cost efficiency and flexibility in application.

SUMMARY OF THE INVENTION

The present invention provides improved apparatus and methods of forming a curved structure which meet the needs described above.

The apparatus for forming curved structures comprises a plurality of pivotally connected sections, each section having a first track portion, and a first strap member slidably engaging the first track portion of the sections such that the sections are movable to form a radius of curvature.

The method of forming a curved structure comprises providing a first runner and a second runner, each runner having a plurality of pivotally connected sections, each section having two oppositely positioned, generally parallel track portions, each runner further having two strap members slidably engaging each of the track portions. The method also includes oppositely placing the first runner and the second runner in a curved position such that the track portions of the first runner are substantially aligned with the track portions of the second runner and attaching a plurality of studs between the first runner and the second runner.

The present invention provides a strong curved structural support for various applications even when one runner is "floating", i.e., not attached to a structural support such as a ceiling joist. Furthermore, the present invention provides a quick, easy and cost-efficient method of constructing such a curved structure.

It is therefore a general object of the present invention to provide improved apparatus and methods of forming a curved structure. Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIG. 8 is a side elevation of the apparatus illustrated in FIG. 6.

FIG. 9 is a partially sectioned view of a curved wall formed using the apparatus of the present invention.

DETAILED DESCRIPTION OF THE PREFERRED EMBODIMENTS

Figure 1:
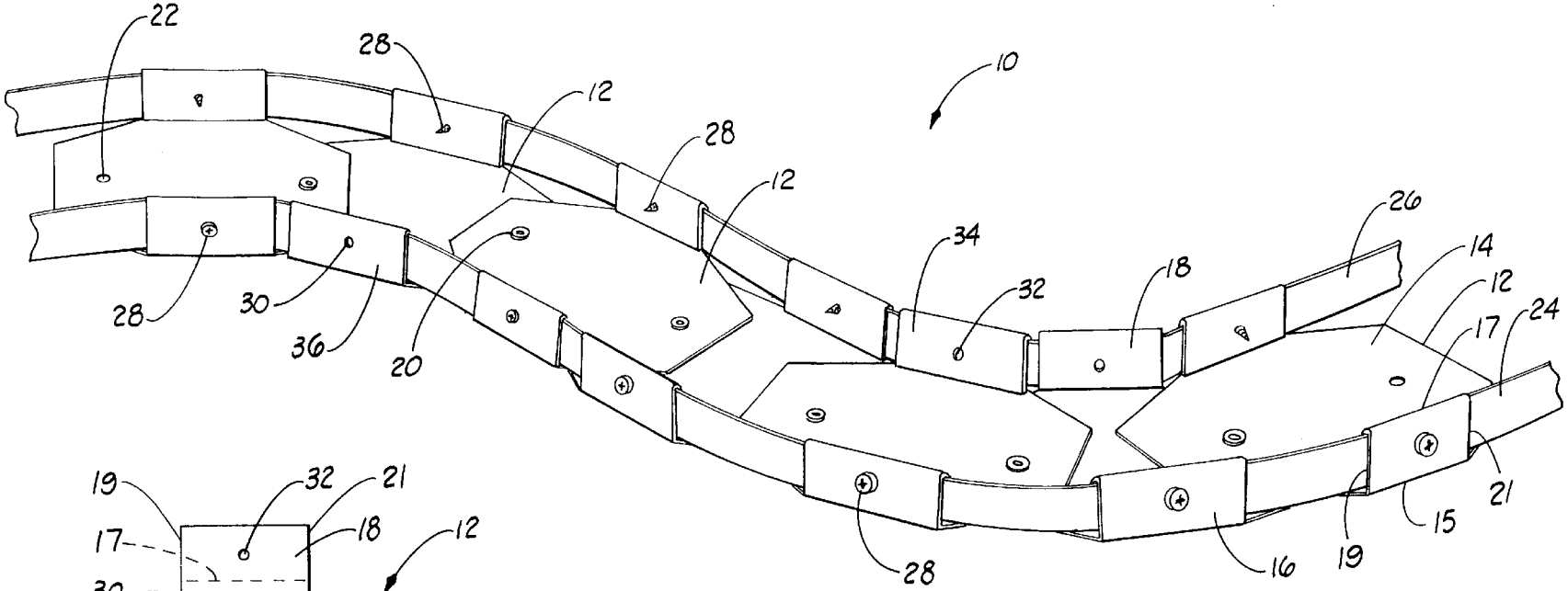
FIG. 1 is a perspective view of the apparatus of the present invention.

Referring to the drawings, presently preferred embodiments of the invention and their operation are illustrated. Like reference numerals refer to like parts throughout the drawings and this description.

Referring to FIG. 1, a presently preferred embodiment of the present invention is illustrated and generally designated by the numeral 10. Apparatus 10 is comprised of a plurality of pivotally connected sections 12. Due to its sectional structure, apparatus 10 can be constructed of virtually any length to fit the desired application.

In a preferred embodiment, each section 10 has a base portion 14, a first track portion 16 and a second track portion 18. First track portion 16 and second track portion 18 are oppositely positioned near the perimeter of base portion 14.

First track portion 16 is oriented generally parallel to second track portion 18. Track portions 16, 18 are oriented generally perpendicular to base portion 14.

Track portions 16, 18 comprise proximate edge 15, which is proximate to base portion 14 and which is formed at the junction of base portion 14 and track portion 16, 18. Track portions 16 further comprise distal edge 17, which is distal in relation to base portion 14 and which, in one embodiment, is formed at the junction of inside surface 34 and outside surface 36. Track portions 16, 18 also comprise first end 19 and second end 21, which are oppositely spaced on the length of track portions 16, 18.

Adjacent sections 12 are pivotally connected by pivot means. Pivot means includes any pivotal connection 20 between adjacent sections 12. For example, pivot means includes a screw, rivet, pop rivet or brad disposed through a hole 22 in base portion 14 of a section 12 and through a hole 22 in base portion 14 in an adjacent section 12. As illustrated for example in FIGS. 1 and 2, pivot means such as pivotal connections 20 are positioned toward opposite ends of each section 12. Pivot means such as pivotal connections 20 are also centrally located. In other words, pivotal connections 20 are substantially equally spaced between the sides of each section 12, i.e., located at a point on base portion 14 approximately on a line which is equidistant from first track portion 16 and from second track portion 18 in a preferred embodiment. Preferably, pivot means includes a round crimp or eyelet formed in overlapping base portions 14 of adjacent sections 12 due to the ease and cost efficiency of such means.

Apparatus 10 includes first strap member 24 which is adapted for slidably engaging first track portion 16 of sections 12. Sections 12 are laterally movable around pivotal connection 20 to form the desired radius of curvature or a variable curve. In a preferred embodiment, apparatus 10 also has a second strap member 26 which is adapted for slidably engaging second track portion 18. When one section 12 is pivoted relative an adjacent section 12, strap members 24, 26 slide relative track portions 16, 18 of a section 12.

The present invention also includes means for fixing apparatus 10 in a predetermined position. Means for fixing includes any means for locking apparatus 10 in the desired position such that adjacent sections 12 are substantially immobilized. For example, means for fixing includes screw 28 disposed through hole 30 in the outside surface 36 of a track portion 16, 18, through strap member 24, 26, and through hole 32 in the inside surface 34 of track portion 16, 18. Means for fixing also includes attaching apparatus 10 to building structure such as by nails or screws disposed through base portions 14 of sections 12, especially through overlapping base portions 14 of adjacent sections 12. Means for fixing further includes connecting overlapping base portions 14 of adjacent sections 12 such as by weld, crimp or adhesive, or by pin, screw, etc., disposed through overlapping base portions 14. Means for fixing the radius of curvature also includes crimping a track portion 16, 18 and strap member 24, 26 disposed therethrough when the radius of apparatus 10 is in the desired position.

Figure 2:
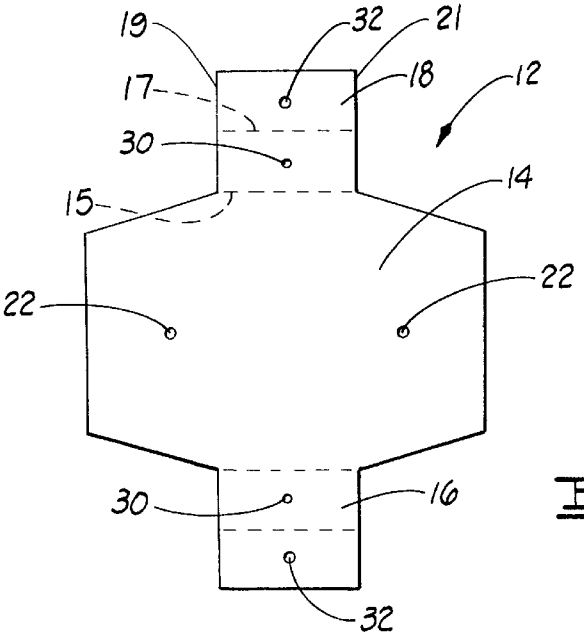
FIG. 2 is an unfolded plan view of a section of the apparatus illustrated in FIG. 1.

Hole 30 and hole 32 may be prepunched, drilled or created by the means for fixing. In a preferred embodiment, outside track hole 30 is smaller than inside track hole 32 to aid in alignment when section 12 is folded as shown in FIG. 2 during manufacture and to prevent the threads of screw 28 from pushing against or catching on the sides of the inside track hole 30. The size differential in hole 30 and hole 32 is minimal so that the inside surface 34 of track portion 16, 18 cannot fold out over the tip of screw 28. Holes 30, 32 may also be located towards an end 19, 21 of track portion 16, 18 such that stud 46 can be subsequently positioned between track portions 16, 18 without interference by screw 28.

In addition to holes 30, 32, another hole (not shown) can be located near distal edge 17 of track portion 16, 18 such that a screw disposed through the hole for the purpose of attaching stud 46 does not interfere with strap member 24, 26. In this embodiment, the width of track portion 16, 18 is greater than the width of strap member 24, 26 to accommodate the additional hole or holes. The additional hole or holes could be separated from strap member 24, 26 by a seam, weld, crimp or other barrier.

FIG. 2 is a plan view of section 12 in an unfolded state. Section 12 can be integrally formed from a single piece of material and folded along the dotted lines to form base portion 14, first track portion 16 and second track portion 18. In a preferred embodiment, sections 12 are formed of twenty-five-gauge or heavier sheet metal. However, plastics, synthetics as well as other materials could be used to form sections 12.

Figure 3:
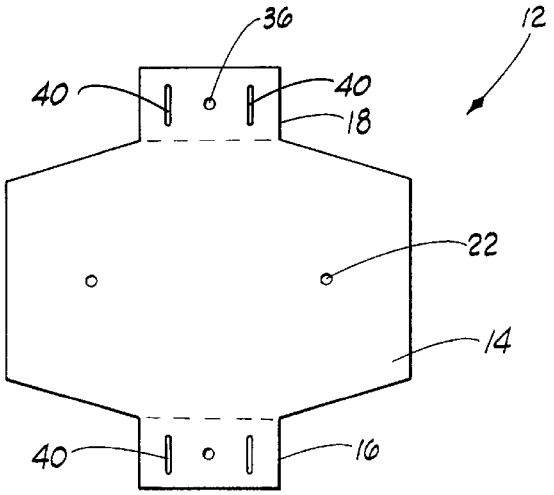
FIG. 3 is a perspective view of the apparatus with an alternate strap construction.
Figure 3:
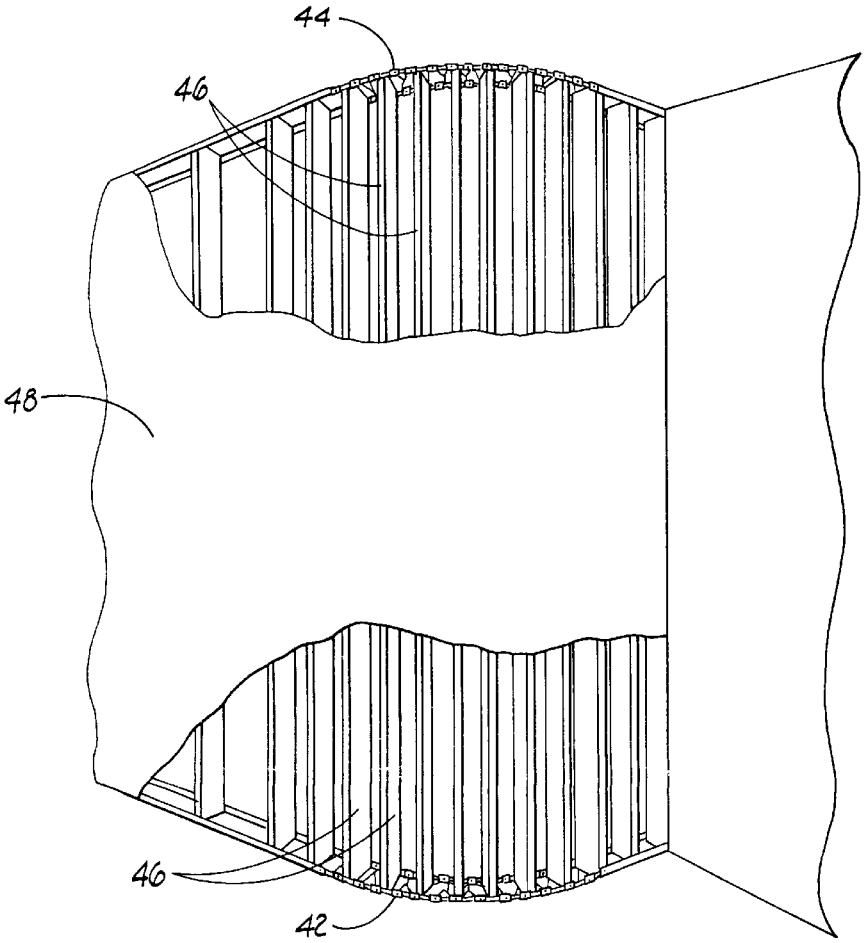
Figure 5:
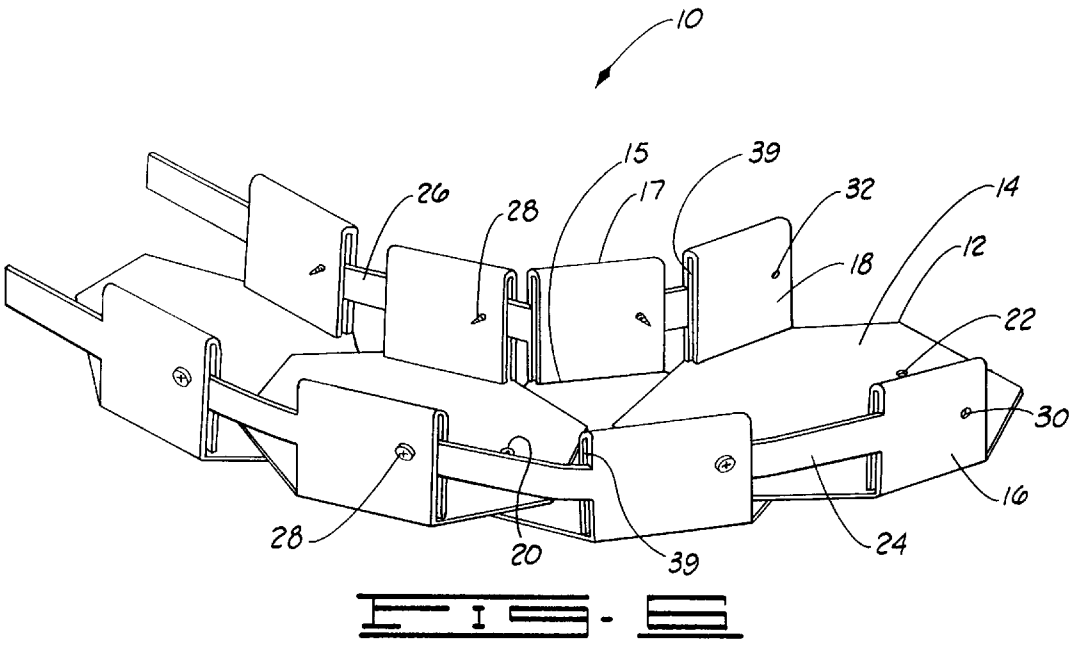

In an alternate embodiment shown in FIG. 3, strap means constitutes wires 38 disposed through channels 39 in track portions 16, 18. Channels 39 can be formed by a weld, crimp or other barrier. The radius of curvature of apparatus 10 can be fixed by collapsing channel 39 around wire 38 such as by crimping or by tightening screw 28. When screw 28 is used to collapse channel 39, hole 32 in inside surface 34 of track portion 16, 18 should be slightly smaller than hole 30 in outside surface 36 of track portion 16, 18 so that screw 28 will pull inside surface 34 and outside surface 36 together. The use of wires 38 in this embodiment allows a radius of curvature to be formed in multiple planes, namely the plane illustrated in FIG. 3 and a plane similar to that illustrated in an alternate embodiment in FIG. 8.

Figure 5:
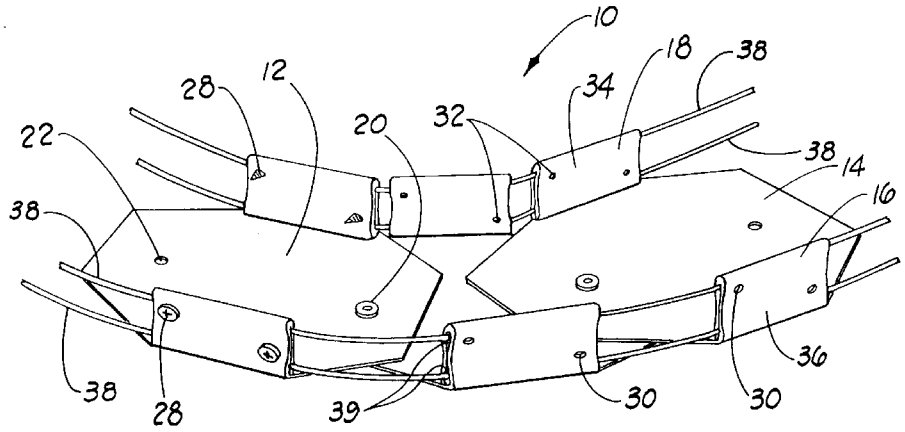
FIG. 5 is an unfolded plan view of a section of the apparatus illustrated in FIG. 4.
Figure 4:
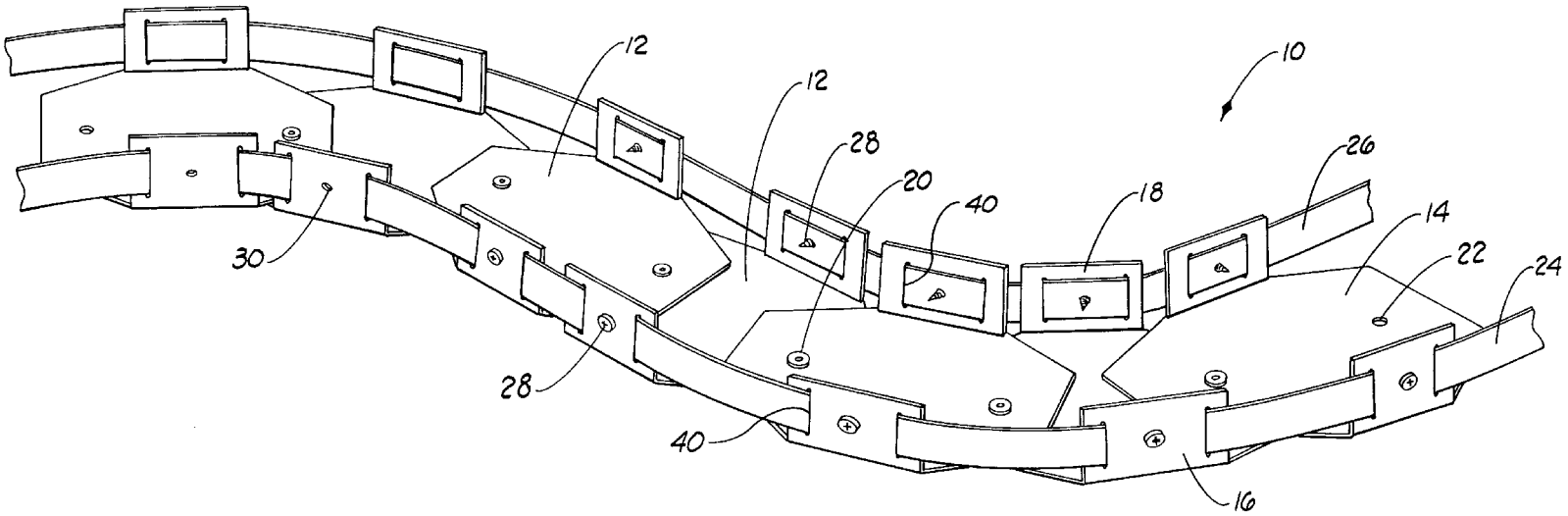
FIG. 4 is a perspective view of the apparatus with an alternate track construction.

FIGS. 4 and 5 illustrate an alternate embodiment of track portions 16, 18. Rather than track portions 16, 18 being folded to create a channel as illustrated in FIGS. 1 and 2, FIGS. 4 and 5 illustrate that track portions 16 and 18 can be formed using slots 40. Strap means such as strap member 24, 26 or wire 38 is disposed through slots 40 such that sections 12 are pivotable by pivot means 20 to form a radius of curvature.

Figure 6:
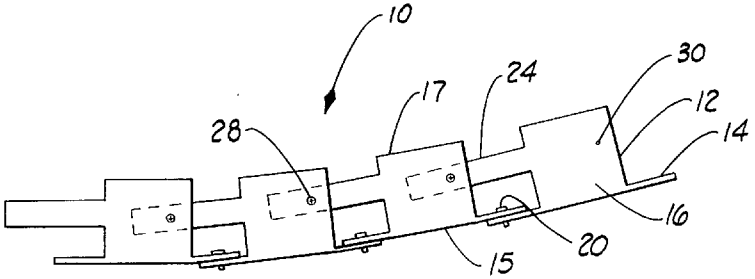
FIG. 6 is a perspective view of an alternate embodiment of the apparatus.
Figure 7:
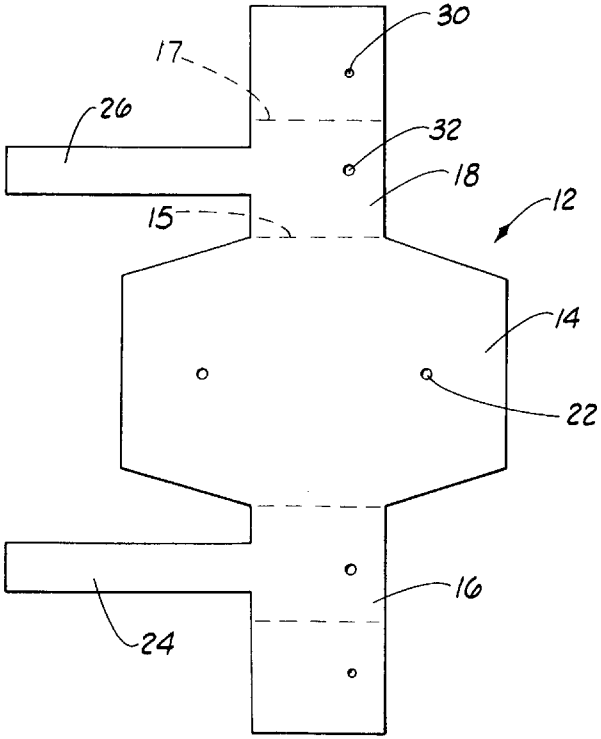
FIG. 7 is an unfolded plan view of a section of the apparatus illustrated in FIG. 6.

In an alternate embodiment shown in FIGS. 6, 7 and 8 strap means such as strap member 24, 26 is integrally formed with and extends from track portions 16, 18 of section 12. Strap member 24, 26 is received in channel 39 of an adjacent section 12. As shown in FIG. 7, channel 39 is created in track portions 16, 18 by folding at the dotted lines. The width of channel 39 is greater than the width of strap member 24, 26. More specifically, distal edge 17 of track portion 16, 18 is spaced apart from strap member 24, 26. This integral structure and spatial relationship permit apparatus 10 to be positioned in a radius of curvature in multiple planes, namely in the plane shown in FIG. 6 and the plane shown in FIG. 8.

FIG. 9 illustrates a curved structure formed using the method and apparatus of the present invention. Apparatus 10 provides a first runner 42 and a second runner 44. First runner 42 and second runner 44 are oppositely placed as shown in FIG. 44. Runners 42, 44 are placed in the desired curved position and the radius of curvature of each runner can be fixed or locked as previously discussed herein. Track portions 16, 18 of first runner 42 are substantially aligned with track portions 16, 18 of second runner 44. Runners 42 and 44 can be attached to building structure, i.e., as shown in FIG. 9, first runner 42 is attached to floor structure and second runner 44 is attached to ceiling structure. Runners 42, 44 can be attached to building structure for example by driving nails through base portion 14 of sections 12. The present invention will also provide good results when used to construct a curved "floating" wall, i.e., a wall in which runner 44 is not attached to ceiling or other building structure.

Studs 46 are attached between first runner 42 and second runner 44. Studs 46 may be attached, for example, by nails disposed through track portions 16, 18, through strap members 24, 26 and into studs 46. Studs 46 can be formed of wood or metal.

Once studs 46 have been attached to runners 42, 44, wall covering or gypsum board 48, such as SHEETROCK™, is attached to studs 46 using, for example, self-tapping framing screws.

Structures other than curved walls can be formed using the same method. For example, a column structure (not shown) can be formed by positioning the first runner in a circle attached to the floor structure, a second runner in a circle attached to the ceiling structure, studs attached between runners 42, 44 and gypsum board 48 attached to studs 46. Curved archways and barrel ceilings can be similarly constructed.

Thus, the present invention is well adapted to carry out the objects and attain the ends and advantages mentioned as well as those inherent therein. While preferred embodiments of the present invention have been illustrated for the purpose of the present disclosure, changes in the arrangement and construction of parts and the performance of steps can be made by those skilled in the art, which changes are encompassed within the scope and spirit of the present invention as defined by the appended claims.

What is claimed is:

1. An apparatus for forming curved structures comprising:

a plurality of sections, each section having a base portion and a first track portion;

a pivotal connection centrally located toward each end of said base portion, said pivotal connection pivotally connecting adjacent sections;

a first strap member slidably engaging said first track portion of said sections such that said sections are movable to form a radius of curvature; and means for fixing said radius in a predetermined position wherein said means for fixing includes a screw disposed through said first track portion and through said first strap member.

2. The apparatus of claim 1 wherein said sections have a base portion oriented generally perpendicular to said first track portion and a second track portion oriented generally parallel to said first track portion and generally perpendicular to said base portion, said second track portion adapted for slidably engaging a second strap member.

3. The apparatus of claim 1 wherein said first strap member comprises a wire such that said radius of curvature can be formed in multiple planes.

4. An apparatus for forming curved structures comprising:

a plurality of sections, each of said sections having a base portion, a first track portion and a second track portion, said track portions being oppositely positioned and generally parallel such that said track portions and said base portion form a channel;

pivot means pivotally connecting adjacent sections; and strap means slidably engaging said first track portion and said second track portion such that said sections are positionable to form a variable curve, wherein said strap means comprises a wire slidably engaging said first track portion and said second track portion of said sections such that said curve can be formed in a vertical plane as well as in a horizontal plane.

5. The apparatus of claim 4 wherein said pivot means includes an eyelet.

6. The apparatus of claim 4 wherein said first track portion and said second track portion include a slot for receiving said strap means.

7. The apparatus of claim 4 wherein said strap means includes a strap member integrally formed with and extending from said first track portion and said second track portion of said sections.

8. The apparatus of claim 4 wherein said strap means includes a strap member slidably engaged in a channel formed in said first track portion and said second track portion of said sections.

9. The apparatus of claim 5 further comprising means for fixing said curve in a predetermined position.

10. The apparatus of claim 4 wherein said pivot means comprises a pivotal connection centrally located toward each end of said base portion.

11. A method of forming a curved structure comprising:

providing a first runner and a second runner, each said runner having a plurality of pivotally connected sections, each said section having two oppositely positioned, generally parallel track portions, each said runner further having two strap members slidably engaging each of said track portions;

oppositely placing said first runner and said second runner in a curved position such that said track portions of said first runner are substantially aligned with said track portions of said second runner; and attaching a plurality of studs between said first runner and said second runner.

12. The method of claim 11 further comprising fixing said first runner and said second runner in said curved position.

13. The method of claim 12 wherein said fixing step includes attaching said strap members relative said track portions.

14. The method of claim 11 wherein said placing step includes attaching said first runner to a floor support and said second runner to a ceiling support.

15. The method of claim 11 wherein said attaching step further comprises connecting one end of said studs to said track portions of said first runner and another end of said studs to said track portions of said second runner.

16. The method of claim 11 further comprising screwing a wall covering to said studs.

17. An apparatus for forming curved structures comprising:

a plurality of pivotally connected sections, each section having a first track portion;

a rivet connecting adjacent sections; and a first strap member slidably engaging said first track portion of said sections such that said sections are movable to form a radius of curvature.

18. The apparatus of claim 17 further comprising a second track portion slidably engaging a second strap member, said second track portion oriented generally parallel to said first track portion and generally perpendicular to said base portion such that said track portions and said base portion form a channel.

19. The apparatus of claim 17 wherein said rivet is centrally located toward each end of said base portion.

20. The apparatus of claim 17 further comprising means for fixing said radius in a predetermined position.

21. The apparatus of claim 20 wherein said means for fixing includes a screw disposed through said first track portion and through said first strap member.

* * * * *

UNITED STATES PATENT AND TRADEMARK OFFICE

CERTIFICATE OF CORRECTION

Patent No.: 6,000,181

Dated: December 14, 1999

Inventor(s): Frank Wheeler

It is certified that errors appear in the above-identified patent and that said Letters Patent is hereby corrected as shown below:

Claim 2, lines 1-3, delete "wherein said sections have a base portion oriented generally perpendicular to said first track portion and" and insert --further comprising-- therefor; line 5, delete "adapted for".

Claim 9, line 1, delete "5" and insert --4-- therefor.

Signed and Sealed this

Tenth Day of April, 2001

*Attest:*

Nicholas P. Godici

NICHOLAS P. GODICI

*Attesting Officer*

*Acting Director of the United States Patent and Trademark Office*